US006491809B1

(12) United States Patent
Briot et al.

(10) Patent No.: US 6,491,809 B1
(45) Date of Patent: Dec. 10, 2002

(54) SYNTHETIC OIL WITH A HIGH VISCOSITY NUMBER AND A LOW POUR POINT

(75) Inventors: Patrick Briot, Pommier de Beaurepaire (FR); Alain Forestiere, Vernaison (FR); Serge Gautier, Marcoussis (FR); Eric Benazzi, Chatou (FR); Leon Lew, Caracas (VE)

(73) Assignees: Institut Francais du Petrole, Rueil Malmaison Cedex (FR); Industrias Venoco C.A., Caracus (VE)

( * ) Notice: Subject to any disclaimer, the term of this patent is extended or adjusted under 35 U.S.C. 154(b) by 0 days.

(21) Appl. No.: 09/671,294

(22) Filed: Sep. 27, 2000

(30) Foreign Application Priority Data

May 2, 2000 (FR) ..... 00 05676

(51) Int. Cl.[7] ..... C10M 105/06; C10M 105/02

(52) U.S. Cl. ..... 208/18; 508/110; 585/20; 585/24

(58) Field of Search ..... 208/18; 508/110; 585/20, 24

(56) References Cited

U.S. PATENT DOCUMENTS 3,173,965 A 3/1965 Pappas et al.
3,478,113 A 11/1969 Bray et al.
4,148,834 A 4/1979 Kennedy
4,427,561 A * 1/1984 Kusayanagi et al. ..... 252/45
5,008,460 A * 4/1991 Garwood et al. ..... 585/11
5,362,375 A * 11/1994 Kubo et al. ..... 208/19
5,658,865 A * 8/1997 Yoshida et al. ..... 508/501
6,251,300 B1 * 6/2001 Takigawa et al. ..... 252/67

FOREIGN PATENT DOCUMENTS

EP 0 168 534 A 1/1986
GB 1253190 A 11/1971
GB 1467366 A 3/1977

* cited by examiner

*Primary Examiner*—Ellen M. McAvoy
(74) *Attorney, Agent, or Firm*—Millen, White, Zelano & Branigan, P.C.

(57) ABSTRACT

Synthetic oil that contains wholly or partly of dialkylbenzenes and/or partially or totally hydrogenated dialkylbenzenes. The synthetic oil according to the invention can also be used as an oil base or oil base additive and comprises at least one dialkylbenzene and/or at least one partially or totally hydrogenated dialkylbenzene and meets the general chemical formula:

R1—A—R2 in which R1 and R2 represent alkyl groups and A is a benzene core and/or a cyclohexane core and/or a cyclohexene core and/or a cyclohexadiene core and is characterized in that it contains between 1 and 20% by weight or ortho isomers and in that at least one of the alkyl groups is attached for the most part to group A by carbon 2 of the aliphatic chain. The two alkyl groups are preferably attached for the most part to group A by carbon 2 of the aliphatic chain.

4 Claims, 5 Drawing Sheets

SYNTHETIC OIL WITH A HIGH VISCOSITY NUMBER AND A LOW POUR POINT

CROSS-REFERENCE TO RELATED APPLICATION

This application may be related to Applicant' concurrently filed application Attorney Docket No. PET 1883, entitled "Process For Producing, Jointly Or Otherwise, Monoalkyl Aromatic Compounds, Dialkyl Aromatic Compounds And Trialkyl Aromatic Compounds", based on French Application 00/05.677 filed May 2, 2000.

1. Field of the Invention

The process that is the object of this application is a process for alkylating or transalkylating aromatic compounds for the purpose of producing alkylaromatic compounds. The aromatic monoalkyls find a use in the composition of gasolines or lyes, aromatic dialkyls and trialkyls in the field of lubricants.

The process according to the invention thus makes possible the production of mono-, di- and trialkyl aromatic compounds. This process thus relates to the alkylation of aromatic compounds (benzene, toluene, cumene) by alkylating agents (olefins, alcohol, halides) for producing aromatic monoalkyls whose grafted aliphatic chain comprises a carbon number that is selected from 2 to 20 carbon atoms.

2. Background of the Invention

This process can also produce dialkylbenzenes, i.e., aromatic compounds where the benzene core comprises two paraffin chains whose carbon atom number can be identical or different. Each of these aliphatic chains can contain 2 to 20 carbon atoms. In the case where it would be desired to produce aromatic trialkyls, there are three aliphatic chains of which two, for example, have identical lengths.

The alkylation of aromatic compounds has been known for many years.

U.S. Pat. No. 2,939,890 (Universal Oil Products Company), dating from 1960, thus claims a process for synthesis of cumene by using BF3 as a catalyst.

U.S. Pat. No. 3,173,965 (Esso Research), dating from 1965, which claims as suitable catalysts for the alkylation of benzene acids of type AlCl3, AlBr3, FeCl3, SnCl4, BF3, H2SO4, P2O5 and H3PO4, is also known.

In the same connection, U.S. Pat. No. 4,148,834 (1979) and U.S. Pat. No. 4,551,573 (1985) claim the use for the first of HF during the first stage and AlCl3 or AlBr3 in the second stage. The second patent claims, more particularly, a mixture of aluminum halides and elementary iodine.

U.S. Pat. No. 3,251,897 claims the use of X and Y zeolites that are exchanged with rare earths for the production of monoalkyl benzene (ethylbenzene, cumene) and diethylbenzene.

General Formula I

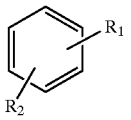

The dialkylbenzenes are compounds whose characteristics one extensively described.

American U.S. Pat. No. 3,173,965 describes the properties of products of general formula (I) whose R1 and R2 alkyl chains are located in para-position on the benzene cycle. These chains have between 4 and 15 carbon atoms for R1 and between 10 and 21 carbon atoms for R2. The patentees emphasize in particular that the dialkylaromatic compounds whose alkyl groups are in ortho and meta position have the least advantageous lubricating properties.

U.S. Pat. No. 3,478,113 teaches the properties of a synthetic oil of the same general formula 1. In this case, R1 has between 6 and 15 carbon atoms and R2 has between 14 and 24 carbon atoms. The sum of the aliphatic carbon number should be between 20 and 30 carbon atoms. The product can be substituted in the ortho or in the para. The generic formula specifies that the carbons in alpha position of the phenyl group are secondary carbons for the R1 and R2 groups ($R—CH_2—Ph—CH_2—R'$ with $R1=R—CH_2$ and $R2=R'—CH_2$).

European Patent EP 168534 describes the properties of synthetic oils of the same generic formula I. In this case, R1 has between 2 and 4 carbon atoms and R2 has between 14 and 18 carbon atoms. These oils have overall between 23 and 28 carbon atoms that correspond to between 17 and 22 aliphatic carbon atoms. The patentees reveal good physical properties of these oils when one of the two alkyl chains is much shorter than the other.

U.S. Pat. No. 4,148,834 teaches a process that makes it possible to improve the physical properties of the oils by synthesizing the latter in two successive stages:

- synthesis of monoalkylbenzene by using hydrofluoric acid HF as a catalyst,
- obtaining dialkylbenzene starting from monoalkylbenzene that is obtained during the first stage by using aluminum chloride or bromide as a catalyst.

In the final product, R1 and R2 comprise between 6 and 18 carbon atoms. The product is characterized by the presence of the phenyl group on carbon 2 of the aliphatic chain with a rate that is greater than 20% in one of groups R1 or R2 and less than 20% in the other.

SUMMARY OF THE INVENTION

This invention relates to a synthetic oil that comprises wholly or partly of dialkylbenzenes and/or partially or totally hydrogenated dialkylbenzenes. The synthetic oil according to the invention can also be used as an oil base or oil base additive and comprises at least one dialkylbenzene and/or at least one partially or totally hydrogenated dialkylbenzene and meets a general chemical formula:

R1—A—R2.

in which R1 and R2 represent alkyl groups and A is a benzene core and/or a cyclohexane core and/or a cyclohexene core and/or a cyclohexadiene core and is characterized in that it contains between 1 and 20% by weight of ortho isomers and in that at least one of the alkyl groups is attached for the most part to group A by carbon 2 of the aliphatic chain. The two alkyl groups are preferably attached for the most part to group A by carbon 2 of the aliphatic chain. Within the meaning of this description, the term for the most part means that at least 50% of at least one of the alkyl groups is attached to group A by carbon 2 of the aliphatic chain and usually at least 80%, often at least 95%, and most often virtually 100%.

The oils according to this invention have viscosity numbers that are much higher than those that it has been possible to describe in the prior art as well as very low pour points.

Another characteristic of the synthesized oils, conditioned by the mixture of hydrocarbons used, resides in very low values for these compositions of the Noack volatility, much less than those obtained with the best lubricating oils described in the prior art. As has already been emphasized, this characteristic is very important because it affects the service life of the lubricating base. A strong Noack volatility is also reflected by a significant atmospheric pollution, a short service life of the oil and the obligation of a frequent renewal, and it therefore poses in particular the economical and ecological problem of storage and treatment of waste oils.

It was found, surprisingly, that the physical properties of the oils described by formula I depend on the proportions of the ortho compound. High viscosity numbers and very low Noack volatilities were found when the synthesized oil according to the invention comprised partially or totally hydrogenated dialkylbenzenes in proportions of between 1 and 20% by weight of ortho isomers and preferably between 3 and 15% by weight. The oil preferably comprises a benzene core and/or a cyclohexane core and/or a cyclohexene core and/or a cyclohexadiene core that has two substituents that consist of aliphatic chains in meta position in proportions of between 1 and 50% and preferably between 3 and 50% by weight. The oil preferably comprises a benzene core and/or a cyclohexane core and/or a cyclohexene core and/or a cyclohexadiene core that has 2 substitutents that consist of aliphatic chains in para position in proportions of between 10 and 95% and even more preferably between 40 and 95% by weight. The sum of the isomers that are present and contained in the oil is equal to 100%. The three isomers are preferably present in the synthetic oil.

The compositions of synthetic oils according to this invention can be obtained by adjusting the proportion of isomers by a simple addition of ortho isomers and/or meta isomers and/or para isomers or equally by all of the synthesis techniques that are known to one skilled in the art.

The dialkylbenzenes can be, for example, prepared by alkylation of benzene with olefins. For this reaction, benzene and pure alpha-olefins whose chain length varies between 6 and 20 carbon atoms and preferably between 8 and 20 atoms were used.

These olefins are mixed with benzene in a molar ratio of benzene to olefin of about 0.1:1 to about 10:1. Preferably, a ratio of between 0.2:1 and 6:1 will be used, and even more preferably between 0.5:1 and 3:1.

Two main types of dialkylbenzenes were prepared:

A type called symmetrical DAB in this description for which the two alkyl chains have the same number of carbon atoms, a type called asymmetrical DAB in this description for which the two alkyl chains have a different number of carbon atoms.

BRIEF DESCRIPTION OF THE DRAWINGS

Attached

EXAMPLE 1

Synthesis of Symmetrical DAB (C14—C14)

Benzene and tetradecene-1 are mixed in a molar ratio of benzene to olefin of 1.5 mol/mol. This feedstock is sent into a reactor that contains a catalyst that comprises 80% of mordenite-type zeolite and 20% alumina. The pressure of the reactor is 6 MPa. The hourly volumetric flow rate (volume of feedstock to volume of catalyst and per hour) is 1 liter/liter/hour. The temperature of the catalyst is kept at 180° C. The products of the reaction contain unconverted benzene, monoalkylbenzenes and dialkylbenzenes. These dialkylbenzenes are separated from other products by distillation.

The NMR spectra of hydrogen and carbon 13 make it possible to determine the structural characteristics of synthesized oils according to techniques that are well known to one skilled in the art. In particular:

The NMR $^1$H spectrum of hydrogen teaches that at least one of the alkyl groups is attached for the most part to the benzene group by carbon 2 of the aliphatic chain.

Figure 1:
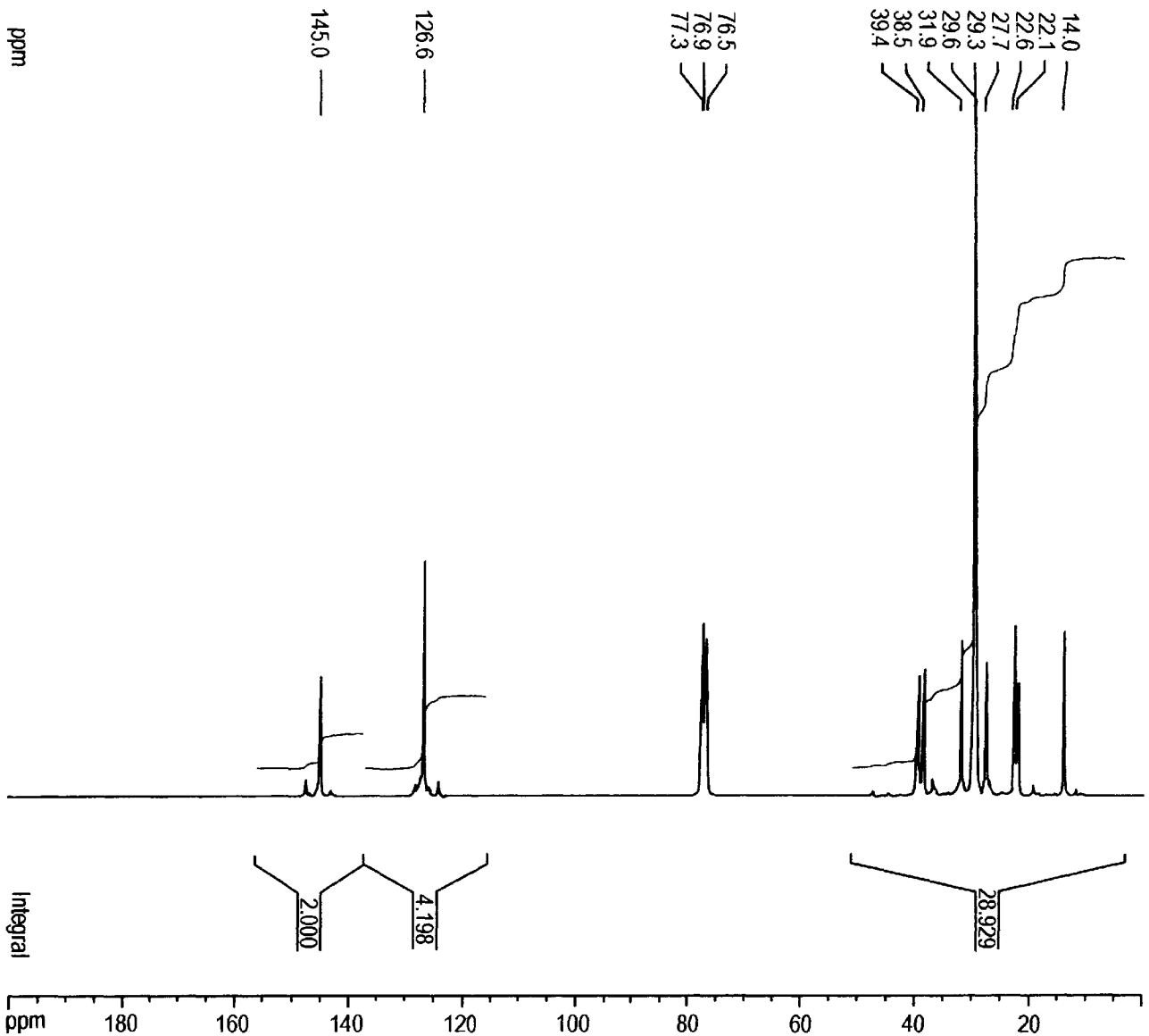
FIGS. 1–5 are graphs which are further explained in the following examples which are purely illustrative and do not at all limit the scope of the invention.

The NMR spectrum of carbon 13 (FIG. 1) makes it possible to show that:

2 carbons of the benzene cycle are linked to an aliphatic carbon. This is therefore a dialkylbenzene, the total number of aliphatic carbon atoms is 28 or 2 chains of 14 carbon atoms each. This product will be called C14—C14.

The NMR $^1$H spectra also make it possible, according to techniques that are well known to one skilled in the art, to know the proportion of each of the ortho/meta/para isomers that are obtained by the synthesis process that is used.

Figure 2:
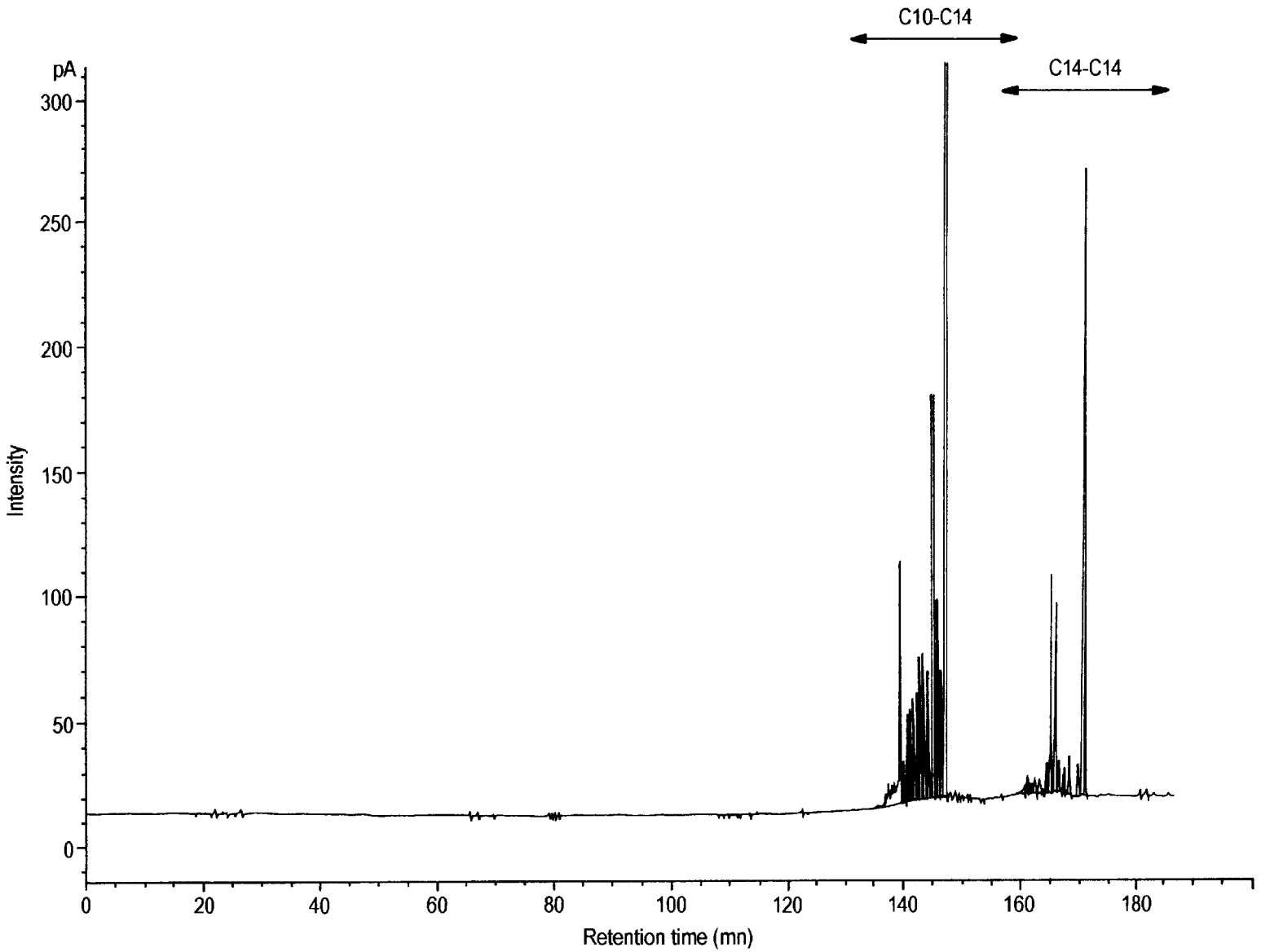

FIG. 2 shows the spectrograms that are obtained by gas chromatography of the C14—C14 symmetrical dialkylated product that is obtained.

EXAMPLE 2

Synthesis of Asymmetrical DAB (C10–C14)

Benzene is mixed with decene-1 with a molar ratio of benzene to olefin of 1.5 mol/mol. The operating conditions are the same as those of Example 1. This feedstock after alkylation makes it possible to obtain C10 monoalkylbenzenes that are separated by distillation.

These monoalkylbenzenes are mixed with tetradecene-1 with a molar ratio of 1 mol/mol. This new feedstock is injected into the alkylation process. The dialkylbenzene that is obtained therefore has two chains of different lengths: one with 10 carbon atoms and the other with 14 carbon atoms, hence the name C10–C14.

FIG. 2 shows the spectrograms that are obtained by gas chromatography of the C10–C14 asymmetrical dialkylated product that is obtained.

A certain number of olefins were used according to the two procedures described in Example 1 and in Example 2. The viscosimetric characteristics of these products are presented in Table 1 and 2 as well as in FIGS. 3, 4 and 5. Table 1 has the characteristics of so-called symmetrical dialkylbenzenes, i.e., that comprise two aliphatic chains that comprise the same carbon number. Table 2 has the characteristics of so-called asymmetrical dialkylbenzenes, i.e., that comprise two aliphatic chains that do not comprise the same carbon number.

TABLE 1

| Symmetrical DAB | C10—C10 | C12—C12 | C14—C14 | C16—C16 | C18—C18 | C20—C20 |
|---|---|---|---|---|---|---|
| Total number of aliphatic carbon atoms | 20 | 24 | 28 | 32 | 36 | 40 |
| Kinematic viscosity at 40° C. in centistokes (cSt) | 13.8 | 21.16 | 29.7 | 42.43 | 60.30 | 83.74 |
| Kinematic viscosity at 100° C. (cSt) | 3.228 | 4.524 | 5.855 | 7.40 | 9.37 | 12.31 |
| Viscosity number | 98 | 130 | 145 | 140 | 136 | 129 |
| Pour point (° C.) | <−45 | −9 | −9 | −6 | +3 | +10 |
| Isomers (%) | | | | | | |
| Ortho | 10 | 5 | 8 | 7 | 9 | 5 |
| Meta | 44 | 5 | 15 | 8 | 7 | 6 |
| Para | 46 | 90 | 77 | 85 | 84 | 89 |

TABLE 2

| Symmetrical DAB | C10–C12 | C10–C14 | C10–C16 | C10–C18 | C20–C20 |
|---|---|---|---|---|---|
| Total number of aliphatic carbon atoms | 22 | 24 | 26 | 28 | 30 |
| Kinematic viscosity at 40° C. (cSt) | 20.63 | 23.35 | 27.17 | 30.92 | 36.50 |
| Kinematic viscosity at 100° C. (cSt) | 4.256 | 4.755 | 5.368 | 5.874 | 6.62 |
| Viscosity number | 111 | 125 | 136 | 136 | 138 |
| Pour point (° C.) | <−45 | <−45 | −33 | −21 | −15 |
| Isomers (%) | | | | | |
| Ortho | 12 | 9 | 5 | 6 | 5 |
| Meta | 20 | 15 | 10 | 5 | 5 |
| Para | 68 | 76 | 85 | 89 | 90 |

The NMR analyses show that the dialkylbenzene compounds that are obtained consist for the most part of para isomer but at most at 90% and not 100% as in U.S. Pat. No. 3,173,965. In addition, the benzene group is for the most part linked to the second carbon atom of the alkyl chains. These characteristics impart to the compositions according to the invention viscosity numbers that are greater than those that are obtained in the compositions that are known and described in the prior art.

Figure 3:
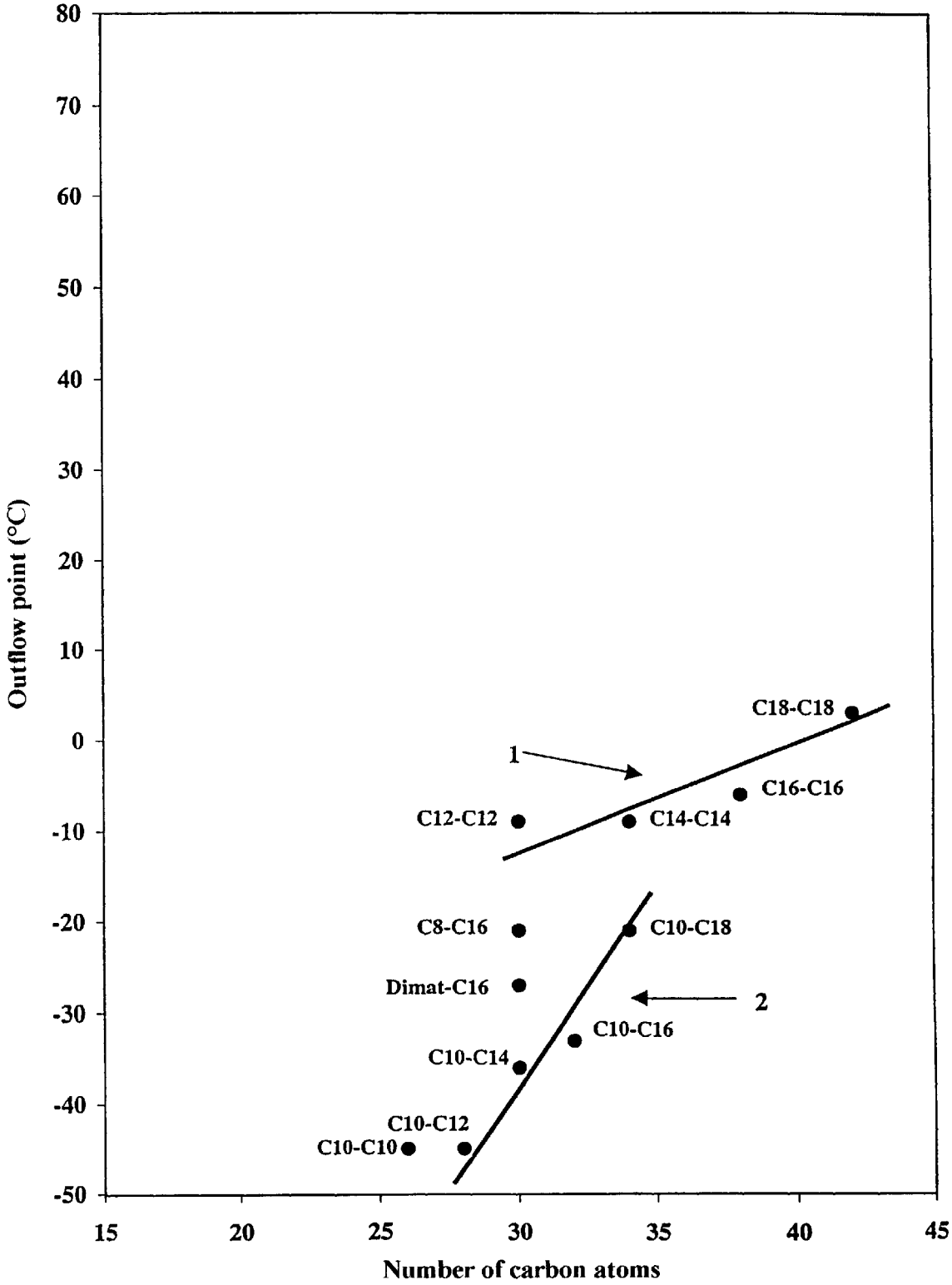

FIG. 3 shows the evolution of the pour point based on the total number of carbon atoms. In the case of asymmetrical dialkylbenzenes, one of the alkyl groups is linked to the benzene group that contains 10 carbon atoms, whereby the other contains between 10 and 18 carbon atoms.

Figure 4:
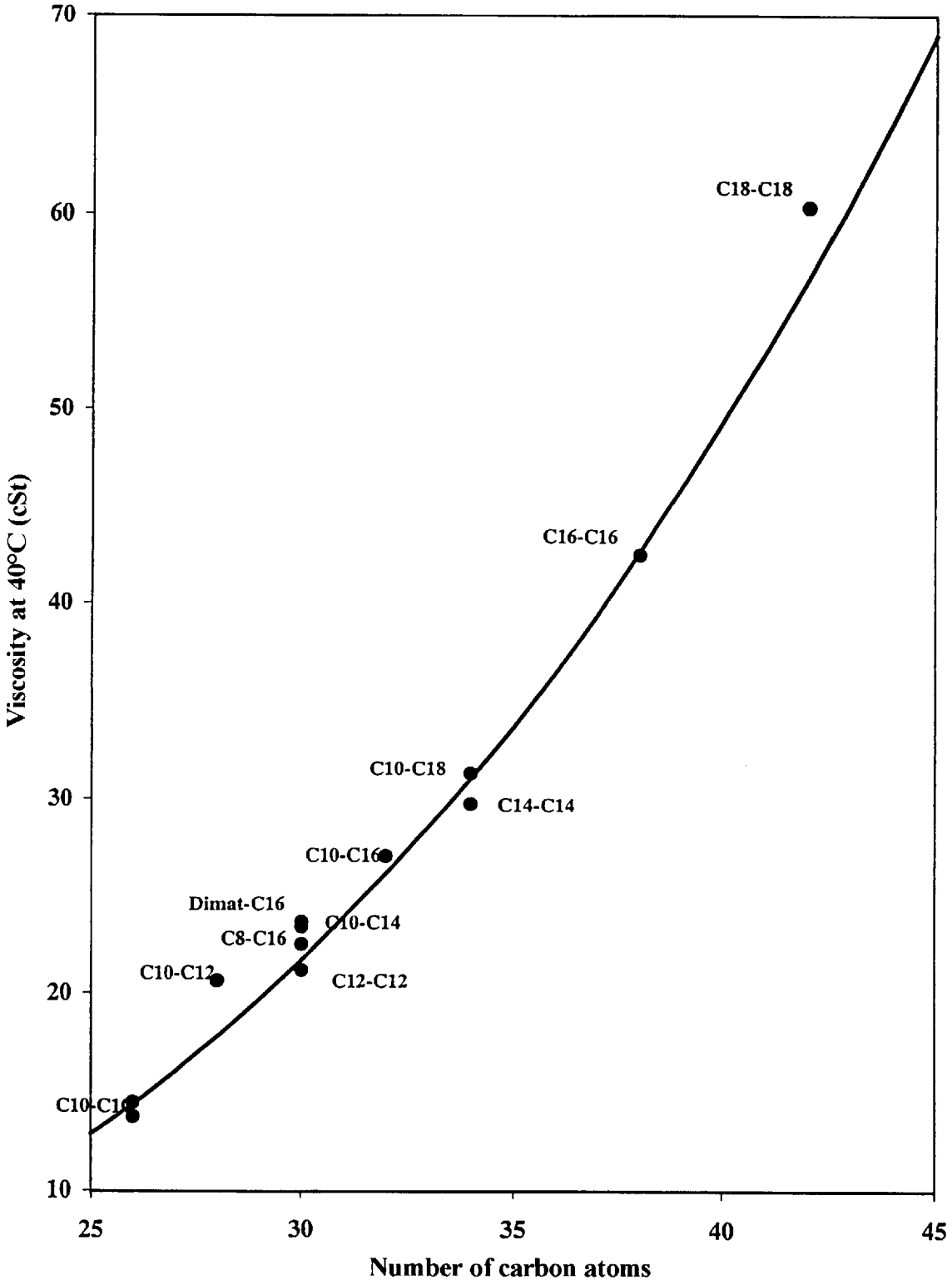

According to the invention, FIG. 4 exhibits the evolution of the viscosity at 40° C. based on the total number of carbon atoms.

Figure 5:
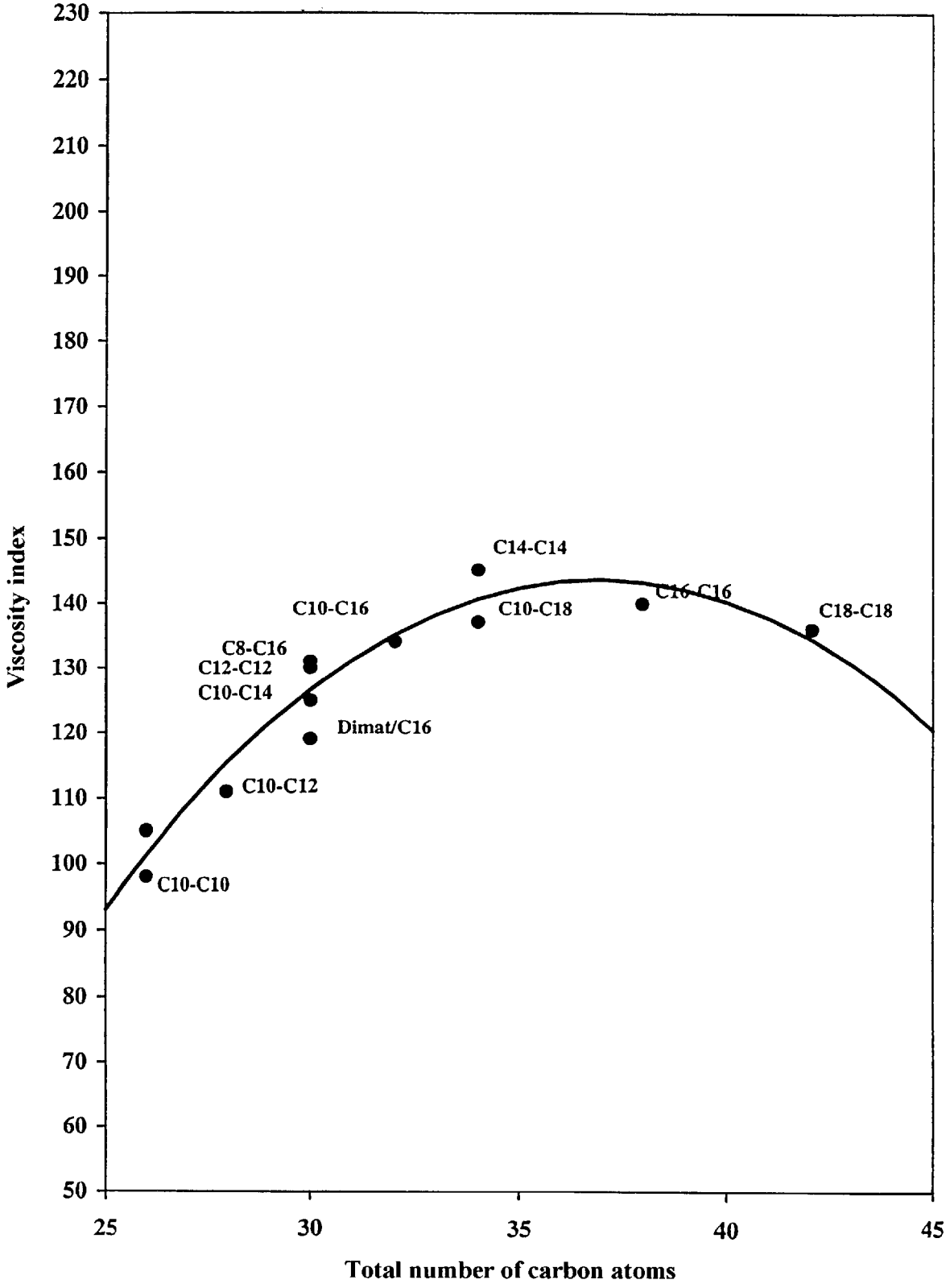

FIG. 5 shows the evolution of the viscosity number based on the total number of carbon atoms.

Table 3 exhibits a comparison of the characteristics of a C12—C12 dialkylbenzene according to this invention and of the composition that is described in U.S. Pat. No. 3,173,965 (Example D/D'). The two products were prepared with the same reagents according to the procedure of the invention, whereby the one described in U.S. Pat. No. 3,173,965 essentially leads to the exclusive formation of para isomers.

TABLE 3

| | C12—C12 (according to the invention) | U.S. Pat. No. 3,173,965 Example D/D' C12—C12 |
|---|---|---|
| Kinematic viscosity at 40° C. (cSt) | 21.16 | 19.43 |
| Kinematic viscosity at 100° C. (cSt) | 4.524 | 4.11 |
| Viscosity number | 130 | 113 |
| Pour point (° C.) | −9 | −40 |

It is noted that the composition according to the invention that contains a mixture of ortho, meta and para isomers has a better viscosity number and a higher kinematic viscosity than the composition that is obtained according to the procedure that is described in U.S. Pat. No. 4,173,965.

EXAMPLE 3

Comparison of the Noack Volatilities

As mentioned above, the oils that are obtained according to this invention have a Noack volatility that is much lower than that of the best lubricating base that is currently on the market. Table 4 exhibits a comparison of three oils with very close kinematic viscosities (same class). Two of these lubricating bases are the object of this invention and the third is an oil that is obtained by polymerization of olefins and ordinarily called Poly-Alpha-Olefin 6 (or PAO 6).

TABLE 4

| | C10–C16 | C10–C18 | PAO 6 |
|---|---|---|---|
| Viscosity at 40° C. (cSt) | 27.17 | 30.92 | 31 |
| Viscosity at 100° C. (cSt) | 5.368 | 5.874 | 5.9 |
| Viscosity number | 136 | 136 | 137 |
| Pour point (° C.) | −33 | −21 | −70 |

TABLE 4-continued

| | C10–C16 | C10–C18 | PAO 6 |
|---|---|---|---|
| Noack volatility (% by weight) | <1 | <1 | 7 |
| Simulated distillation D 2887) | | | |
| 1% by weight (° C.) | 433 | 395 | 369 |
| 5% by weight (° C.) | 444 | 430 | 391 |
| 50% by weight (° C.) | 468 | 474 | 476 |
| 95% by weight (° C.) | 494 | 498 | 525 |

The results that are exhibited in Table 5 show that the oils of this invention (C10–C16 and C10–C18) have distillation temperatures for the starting point that are higher than those of PAO 6 which is reflected by a very low Noack volatility for identical kinematic viscosities. These oils will therefore pollute the environment less and will last longer than the PAO 6 oil.

EXAMPLE 4

Influence of a Branched C8–C16 Olefin

A preparation was made with a C16 alpha-olefin to prepare a monoalkylbenzene according to the same procedure as in Example 2. This monoalkylbenzene was separated by distillation and mixed with an octene fraction obtained by dimerization of butene according to the process developed by the applicant known under the name of dimersol. This octene fraction is characterized by the fact that it is branched. The C8R–C16 dialkylbenzene obtained was compared to the one obtained with an octene-1 (linear) or C8–C16. The results that are obtained are exhibited in Table 5.

TABLE 5

| | C8–C16 (linear) | C8R–C16 (branched) |
|---|---|---|
| Kinematic viscosity at 4° C. (cSt) | 22.47 | 23.58 |
| Kinematic viscosity at 100° C. (cSt) | 4.711 | 4.702 |
| Viscosity number | 131 | 119 |
| Pour point (° C.) | −21 | −27 |

The oils according to the invention can advantageously be hydrogenated according to any technique that is known to one skilled in the art. The dialkylbenzenes are then transformed at least in part into dialkylcyclohexadiene and/or dialkylcyclohexene and/or dialkylcyclohexane. This transformation makes it possible, while at the same time retaining the properties under cold conditions (pour point), to improve the viscosity number considerably.

These oils were hydrogenated in a batch reactor while being stirred under a hydrogen pressure of 60 bars. The catalyst contains 0.6% by weight of palladium deposited on alumina. The temperature is 250° C., and the reaction time is 16 hours.

Table 6 shows two examples that are obtained with the preceding oils.

TABLE 6

| | C10–C16 | Hydro-genated C10–C16 | C10–C18 | Hydro-genated C10–C18 |
|---|---|---|---|---|
| Viscosity at 40° C. (cSt) | 27.17 | 28.28 | 30.92 | 28.61 |
| Viscosity at 100° C. (cSt) | 5.368 | 5.304 | 5.874 | 5.838 |
| Viscosity number | 136 | 139 | 136 | 139 |
| Pour point (° C.) | −33 | −33 | −21 | −21 |

EXAMPLE 5

Comparison of a Mixture of Isomers Obtained Catalytically or by Mixing Pure Compounds The dialkylbenzenes were prepared by alkylation by HF and $AlCl_3$. The different ortho-meta-para isomers obtained are separated on a molecular sieve. The three pure isomers are then mixed again to obtain ortho meta-para isomeric proportions that are identical to those obtained by a dialkylation reaction of benzene when mordenite is used as a catalyst. The properties that are obtained are approximately identical (Table 7).

TABLE 7

| | C14—C14 mordenite | C14—C14 mixture |
|---|---|---|
| Kinematic viscosity at 40° C. (cSt) | 29.7 | 30 |
| Kinematic viscosity at 100° C. (cSt) | 5.855 | 5.88 |
| Viscosity number | 145 | 144 |
| Pour point (° C.) | −9 | −6 |
| Isomers (%) | | |
| Ortho | 8 | 7.5 |
| Meta | 15 | 15.5 |
| Para | 77 | 77 |

This example shows that only the composition of the oil influences the viscosity properties that are independently of the method of obtaining them.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 00/05.677, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A synthetic oil or oil base or oil base additive that comprises at least one dialkylbenzene and/or at least one partially or totally hydrogenated dialkylbenzene, of general chemical formula:

R1—A—R2, in which R1 and R2 represent alkyl groups of equal lengths and A is a benzene core and/or a cyclohexane core and/or a cyclohexene core and/or a cyclohexadiene core, wherein said R1—A—R2 comprises 1 to 20% by weight of ortho isomers and in that at least one of the alkyl groups is attached for the most part to group A by carbon 2 to the aliphatic chain.

2. A synthetic oil or oil base or oil base additive that comprises at lest one dialkylbenzene and/or at least one partially or totally hydrogenated dialkylbenzene, of general chemical formula:

R1—A—R2, in which R1 and R2 represent alkyl groups and A is a benzene core and/or a cyclohexane core and/or a cyclohexane core and/or a cyclohexadiene core, wherein said R1—A—R2 comprises 1 to 20% by weight of ortho isomers and in that at least one of the alkyl groups is attached for the most part to group A by carbon 2 of the aliphatic chain and wherein the synthetic oil or oil base or oil base additive contains 10 to 90% by weight of para isomers of a dialkylbenzene and/or at least one partially or totally hydrogenated dialkylbenzene, whereby the sum of the isomers present is equal to 100%, and wherein the length of the smallest aliphatic chain comprises 8 to 20 carbon atoms.

3. A synthetic oil or oil base or oil base additive that comprises at least one dialkylbenzene and/or at least one partially or totally hydrogenated dialkylbenzene, of general chemical formula:

R1—A—R2, in which R1 and R2 represent alkyl groups and A is a benzene core and/or a cyclohexane core and/or a cyclohexene core and/or a cycohexadiene core, wherein said R1—A—R2 comprises 1 to 20% by weight of ortho isomers and in that at least one of the alkyl groups is attached for the most part to group A by carbon 2 of the aliphatic chain wherein the length of smallest aliphatic chain R1 or R2 comprises 6 to 20 carbon atoms.

4. A synthetic oil or oil base or oil base additive that comprises at least one dialkylbenzene and/or at least one partially or totally hydrogenated dialkylbenzene, of general chemical formula:

R1—A—R2, in which R1 and R2 represent alkyl groups and A is a benzene core and/or a cyclohexane core and/or a cyclohexene core and/or a cyclohexadiene core, wherein said R1—A—R2 comprises 1 to 20% by weight of ortho isomers and in that least one of the alkyl groups is attached for the most part to group A by carbon 2 of the aliphatic chain and wherein the length of the smallest aliphatic chain comprises 8 to 20 carbon atoms.

* * * * *

UNITED STATES PATENT AND TRADEMARK OFFICE

CERTIFICATE OF CORRECTION

PATENT NO. : 6,491,809 B1
DATED : December 10, 2002
INVENTOR(S) : Patrick Briot et al.

It is certified that error appears in the above-identified patent and that said Letters Patent is hereby corrected as shown below:

Title page,
Item [73], Assignees, "Caracus (VE)" should read -- Caracas (VE) --

Column 9,
Line 4, reads "carbon 2 to" should read -- carbon 2 of --
Line 7, reads "comprises at lest" should read -- comprises at least --
Line 15, reads "cyclohexane core and/or a cyclohexane core" should read -- cyclohexane core and/or a cyclohexane core --

Signed and Sealed this

Twenty-sixth Day of August, 2003

JAMES E. ROGAN
*Director of the United States Patent and Trademark Office*